US011338347B2

(12) United States Patent
Lee

(10) Patent No.: US 11,338,347 B2
(45) Date of Patent: May 24, 2022

(54) PRESS DEVICE OF MULTI CAM TYPE

(71) Applicants: Hyundai Motor Company, Seoul (KR); Kia Motors Corporation, Seoul (KR)

(72) Inventor: Seho Lee, Ulsan (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 17/087,909

(22) Filed: Nov. 3, 2020

(65) Prior Publication Data

US 2022/0001436 A1 Jan. 6, 2022

(30) Foreign Application Priority Data

Jul. 2, 2020 (KR) ..... 10-2020-0081269

(51) Int. Cl.
*B21D 19/08* (2006.01)
*B21D 28/32* (2006.01)

(52) U.S. Cl.
CPC ..... *B21D 28/325* (2013.01); *B21D 19/084* (2013.01); *B21D 19/086* (2013.01)

(58) Field of Classification Search
CPC .... B21D 19/08; B21D 19/082; B21D 19/084; B21D 28/325; B21D 28/34
USPC ..... 72/452.1, 452.8, 452.9
See application file for complete search history.

(56) References Cited

FOREIGN PATENT DOCUMENTS

| | | | | |
|---|---|---|---|---|
| CN | 107999607 A | * | 5/2018 | |
| FR | 3100726 A1 | * | 3/2021 | ..... B21D 28/325 |
| JP | 04162925 A | * | 6/1992 | |
| KR | 10-2005-0043012 A | | 5/2005 | |
| KR | 10-1560215 B1 | | 10/2015 | |

* cited by examiner

*Primary Examiner* — Debra M Sullivan
(74) *Attorney, Agent, or Firm* — Morgan, Lewis & Bockius LLP

(57) ABSTRACT

A multi-directional multi-cam press device may include a cam base fixed to the lower mold, a first cam slide provided to slide forwards and backwards along a first direction of the cam base, at least a first punch unit provided in the first cam slide along a first direction, a cam drive fixed to an upper mold configured of moving in a vertical direction with respect to the lower mold, and making cam contact with the first cam slide, a second cam slide provided in the cam drive to move forwards and backwards in a second direction perpendicular to the first direction and in contact with the cam base side, and at least a second punch unit provided on the second cam slide along a second direction.

19 Claims, 18 Drawing Sheets

PRESS DEVICE OF MULTI CAM TYPE

CROSS-REFERENCE TO RELATED APPLICATION

The present application claims priority to Korean Patent Application No. 10-2020-0081269 filed on Jul. 2, 2020, the entire contents of which is incorporated herein for all purposes by this reference.

BACKGROUND OF THE INVENTION

Field of the Invention

The present invention relates a press device. More particularly, the present invention relates to a multi-directional multi-cam press device for piercing panel materials on the vehicle body sub-assembly line.

Description of Related Art

In general, to produce one finished body panel, it has to go through several press forming processes. Among these press forming processes, there is a piercing process in which a hole is made in a panel material.

The piercing process is performed by a cam-type piercing press device that forms a piercing hole in a side surface of a panel material using an inclined cam structure. The cam type piercing press device is provided on one side of a press mold for press processing a panel material as a workpiece.

Recently, a multi-directional multi-cam type piercing press device has been developed in which piercing operations are performed in different directions within a narrow structural space of a press mold.

In the multi-directional multi-cam type piercing press device, one cam drive is configured in the upper mold of the press mold, and a plurality of cam slides are configured in the lower mold of the press mold. Accordingly, the cam drive moves the cam slides in different directions, and the panel material may be pierced in different directions through the pierce punch coupled to the cam slides.

However, conventionally, as the cam slides are configured in the lower mold, it is difficult to secure a space in the press mold. Furthermore, when returning the cam slides is completed, it is necessary to extend the driving distance of the cam slides to avoid interference due to the extraction of the panel material. However, the extension of the driving distance of the cam slides may cause mutual interference when the cam slides return.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a multi-directional multi-cam press device configured for piercing in different directions by driving a single cam within the narrow structural space of the press mold.

A multi-directional multi-cam press device according to various exemplary embodiments of the present invention includes a cam base fixed to the lower mold, a first cam slide provided to slide forwards and backwards along a first direction of the cam base, at least a first punch unit provided in the first cam slide along a first direction, a cam drive fixed to an upper mold configured of moving in a vertical direction with respect to the lower mold, and making cam contact with the first cam slide, a second cam slide provided in the cam drive to move forwards and backwards in a second direction perpendicular to the first direction and in contact with the cam base side, and at least a second punch unit provided on the second cam slide along the second direction thereof.

Furthermore, the multi-directional multi-cam press device according to various exemplary embodiments of the present invention may further include a return spring unit connected to the cam base and the first cam slide in the first direction thereof.

Furthermore, in the multi-directional multi-cam press device according to various exemplary embodiments of the present invention, the return spring unit may include a gas spring.

Furthermore, the multi-directional multi-cam press device according to various exemplary embodiments of the present invention may further include a return stopper provided on the cam base corresponding to the first cam slide and configured to limit a return position of the first cam slide.

Furthermore, in the multi-directional multi-cam press device according to various exemplary embodiments of the present invention, the cam base may include at least one main rail block which is mounted to be inclined downwardly from a rear side to a front side through the base inclined surface as an upper surface, and is slidably coupled with the first cam slide.

Furthermore, in the multi-directional multi-cam press device according to various exemplary embodiments of the present invention the cam base may include a pair of sub-rail blocks provided on the inclined surface of the base with the main rail block interposed therebetween, and slidably coupled with the first cam slide.

Furthermore, in the multi-directional multi-cam press device according to various exemplary embodiments of the present invention, the first cam slide may include at least one driven cam plate disposed to be inclined downwardly from a front to a rear corresponding to the cam drive.

Furthermore, in the multi-directional multi-cam press device according to various exemplary embodiments of the present invention, the first cam slide may include a first guide plate fixed on one side surface and another side surface thereof and provided to be in surface-contact with a first guide block provided on both sides of the cam base.

Furthermore, in the multi-directional multi-cam press device according to various exemplary embodiments of the present invention, the first cam slide may include a first return support block fixed on at least one side thereof and slidably coupled to the cam drive.

Furthermore, in the multi-directional multi-cam press device according to various exemplary embodiments of the present invention, the cam drive may include a second return support block provided on a side surface corresponding to the first return support block and slidably coupled with the first return support block.

Furthermore, in the multi-directional multi-cam press device according to various exemplary embodiments of the present invention, the cam drive may include a driving cam plate configured to be in cam contact with the driven cam plate.

Furthermore, in the multi-directional multi-cam press device according to various exemplary embodiments of the present invention, the cam drive may include a second guide plate provided on a rear surface thereof and provided in surface-contact with a second guide block provided on a rear side of the cam base.

Furthermore, in the multi-directional multi-cam press device according to various exemplary embodiments of the present invention, the cam drive may include a guide rail member which is configured to be inclined downwardly from one side to another side along a second direction from the rear side and slidably couples with the second cam slide.

Furthermore, in the multi-directional multi-cam press device according to various exemplary embodiments of the present invention, the guide rail member may include a fixed end portion formed at one end portion and at another end portion of the guide rail member and fixed to a first side and a second side of the cam drive, respectively, and a guide stopper formed at the fixed end portion of the one end portion and limiting a forward position of the second cam slide.

Furthermore, in the multi-directional multi-cam press device according to various exemplary embodiments of the present invention, the second cam slide may have an engaging hole slidably coupled with the guide rail member, and slide between the fixed end portions along the guide rail member.

Furthermore, the multi-directional multi-cam press device according to various exemplary embodiments of the present invention may further include a cam block provided on a base horizontal surface of an upper surface of the cam base, having a cam inclined surface inclined downwardly in an advance direction of the second cam slide, and slidably coupled to a lower surface of the second cam slide.

Furthermore, in the multi-directional multi-cam press device according to various exemplary embodiments of the present invention, on the lower surface of the second cam slide, a cam groove for cam contacting with the cam block may be formed.

Furthermore, in the multi-directional multi-cam press device according to various exemplary embodiments of the present invention, a guide groove may be formed in the cam block along a second direction thereof.

Furthermore, in the multi-directional multi-cam press device according to various exemplary embodiments of the present invention, a guide protrusion slidably coupled to the guide groove may be provided at a lower portion of the second cam slide.

Furthermore, in the multi-directional multi-cam press device according to various exemplary embodiments of the present invention, the first and second punch units may include a pierce tool for piercing a panel material.

According to the exemplary embodiments of the present invention, since piercing processing in different directions is possible even within the narrow structural space of the press mold without process division, the space constraint condition of the press mold may be overcome, and the mold manufacturing cost and process time may be shortened.

Furthermore, effects which may be obtained or predicted by the exemplary embodiments of the present invention will be included directly or implicitly in the detailed description of the exemplary embodiments of the present invention. That is, various effects predicted according to various exemplary embodiments of the present invention will be included within a detailed description to be described later.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
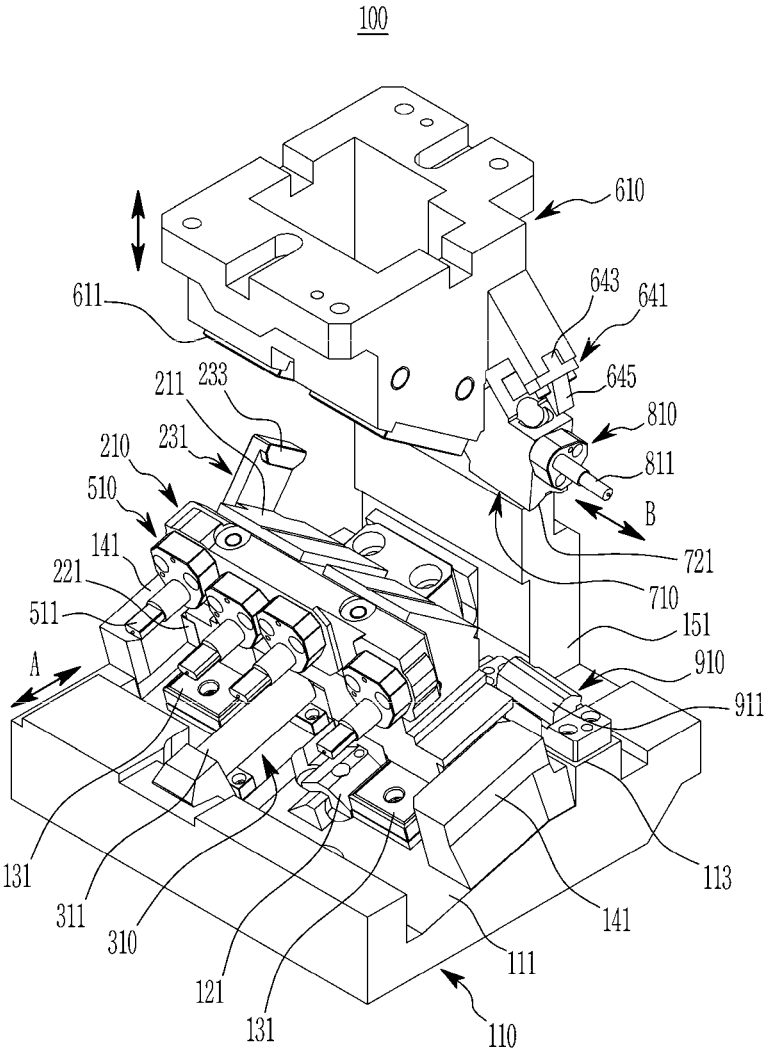
FIG. 1 and FIG. 2 are perspective views illustrating a multi-directional multi-cam type press device according to various exemplary embodiments of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Exemplary embodiments of the present application will be described more fully hereinafter with reference to the accompanying drawings, in which exemplary embodiments of the present invention are shown. As those skilled in the art would realize, the described embodiments may be modified in various different ways, all without departing from the spirit or scope of the present invention.

The drawings and description are to be regarded as illustrative in nature and not restrictive. Like reference numerals designate like elements throughout the specification.

Furthermore, the size and thickness of each component shown in the drawings are arbitrarily shown for understanding and ease of description, but the present invention is not limited thereto, and the thickness of parts, regions, etc., are exaggerated for clarity.

In a detailed description, to distinguish the same constituent elements, a first and a second, etc., are used as names of constituent elements and do not represent the order.

Furthermore, in the entire specification, unless explicitly described to the contrary, the word "comprise" and variations such as "comprises" or "comprising", will be understood to imply the inclusion of stated elements but not the exclusion of any other elements.

Furthermore, the terms "unit", "means", "portion", and "member" described in the specification indicate a unit of a comprehensive constituent element for performing at least one function and operation.

Figure 2:
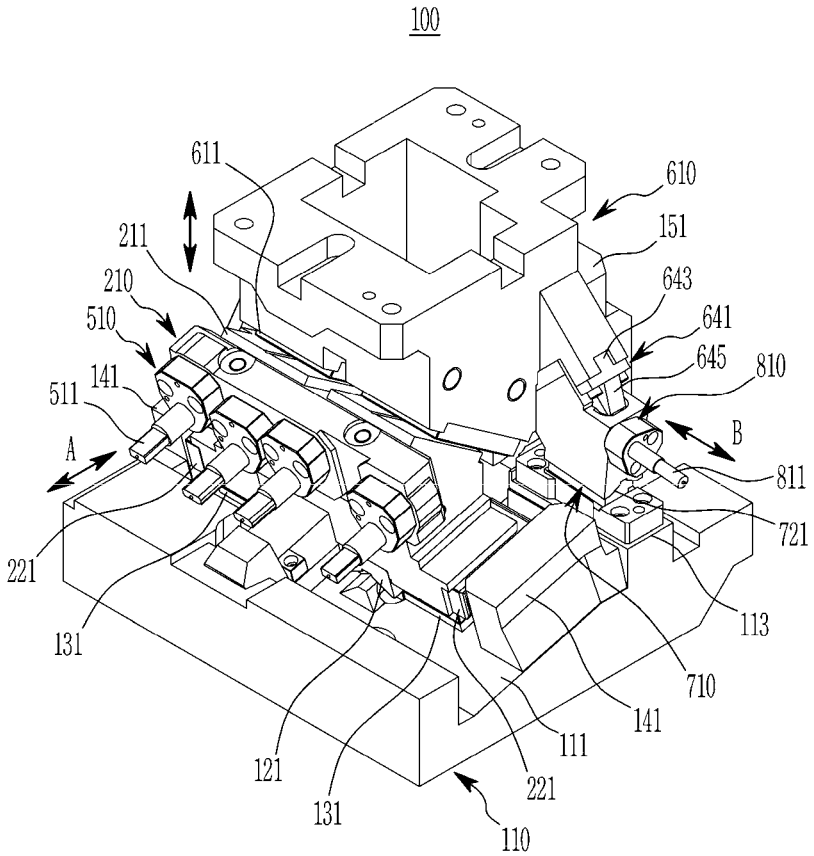
Figure 3A:
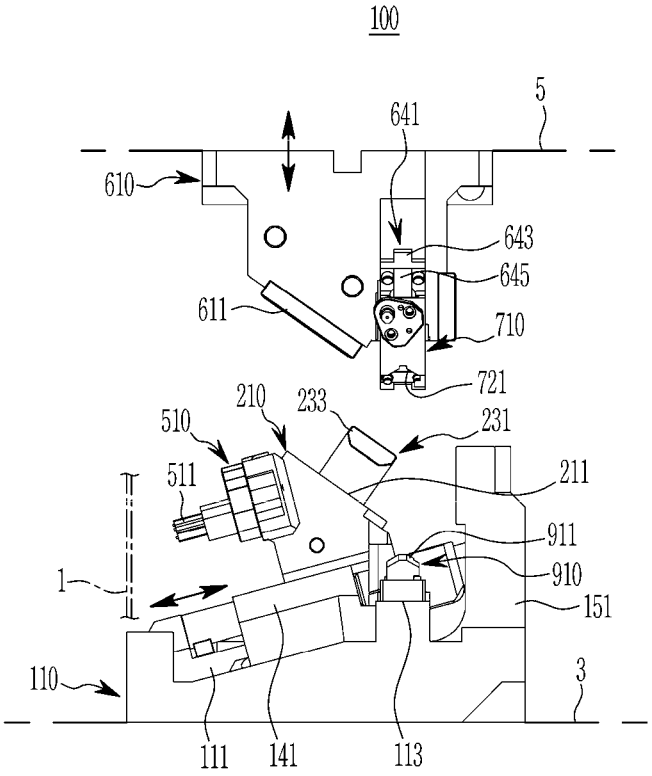
FIG. 3A and FIG. 3B are side schematic diagrams illustrating a multi-directional multi-cam type press device according to various exemplary embodiments of the present invention.
Figure 3B:
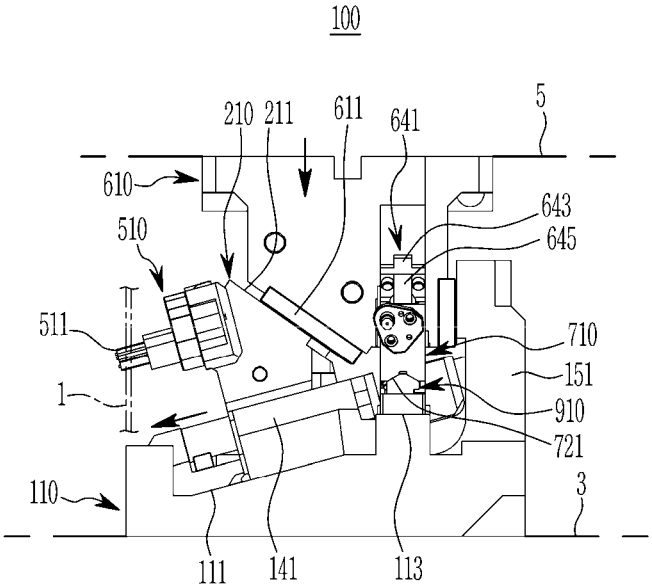

FIG. 1 and FIG. 2 are perspective views illustrating a multi-directional multi-cam type press device according to various exemplary embodiments of the present invention, and FIG. 3A and FIG. 3B are side schematic diagrams illustrating a multi-directional multi-cam type press device according to various exemplary embodiments of the present invention.

Referring to FIG. 1 to FIG. 3B, the multi-directional multi-cam press device 100 according to various exemplary embodiments of the present invention may be applied to a sub-assembly line of a body factory that processes body portions such as body panels that are assembled on a body through several press forming processes.

In the above-described sub assembly line, in addition to the draw molding process of press-forming the vehicle body panel into a set shape, a trim process, a piercing process, a flange banding process and a forming process are performed.

Hereinafter, an example of processing a piercing hole in a set portion of the panel material 1 using the multi-directional multi-cam press device 100 according to various exemplary embodiments of the present invention will be described.

The multi-directional multi-cam press device 100 according to various exemplary embodiments of the present invention may be configured on one side of a press mold system for press-forming the panel material 1 into a set shape.

This press mold system includes a lower mold 3 as a lower die or a fixed die and an upper mold 5 as an upper die or a movable die. In the above, the upper mold 5 is provided to be movable in the vertical direction with respect to the lower mold 3.

Hereinafter, based on the vertical direction, the front-rear direction is set as the first direction, and the left and right direction perpendicular to the first direction is set as the second direction thereof.

Furthermore, the end portion (one/one end portion or the other/one end) in the following may be defined as either end, and it may be defined as a certain portion (one/one end portion or the other/one end) including the end portion.

The multi-directional multi-cam press device 100 according to various exemplary embodiments of the present invention has a structure configured for piercing in different directions by driving a single cam within a narrow structural space of a press mold.

Figure 4:
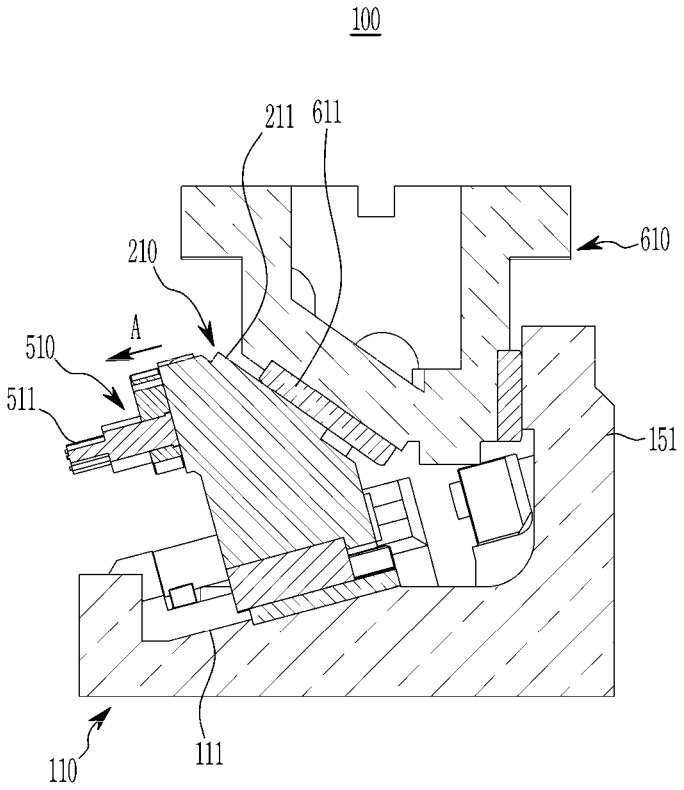
FIG. 4 is a cross-sectional view exemplarily illustrating a multi-directional multi-cam type press device according to various exemplary embodiments of the present invention in a first direction thereof.
Figure 5:
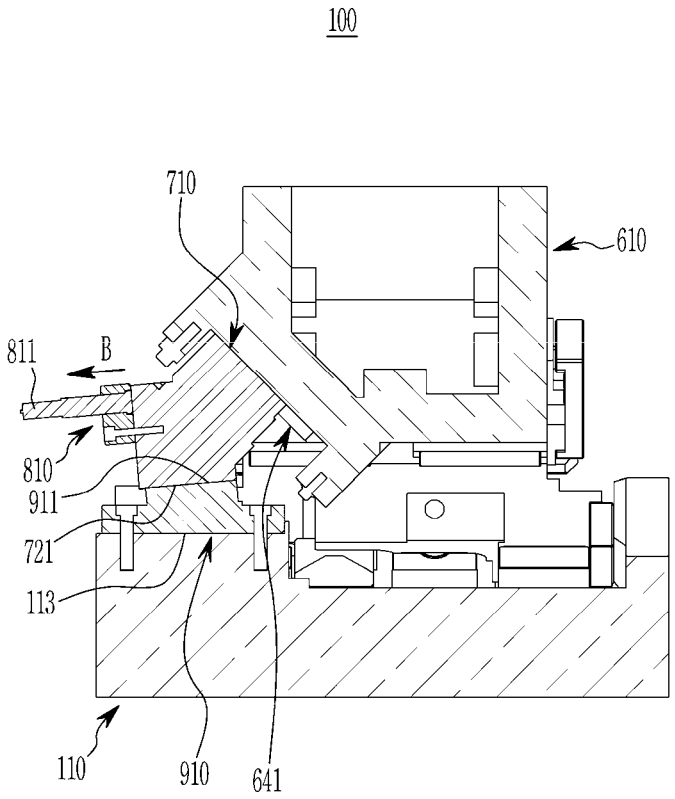
FIG. 5 is a cross-sectional view exemplarily illustrating a multi-directional multi-cam type press device according to various exemplary embodiments of the present invention in a second direction thereof.

FIG. 4 is a cross-sectional view exemplarily illustrating a multi-directional multi-cam type press device according to various exemplary embodiments of the present invention in a first direction thereof, and FIG. 5 is a cross-sectional view exemplarily illustrating a multi-directional multi-cam type press device according to various exemplary embodiments of the present invention in a second direction thereof.

Referring to FIG. 1 to FIG. 5, the multi-directional multi-cam press device 100 according to various exemplary embodiments of the present invention basically includes a cam base 110, a first cam slide 210, a return spring unit 310, and a return stopper 410, a first punch unit 510, a cam drive 610, a second cam slide 710, a second punch unit 810, and a cam block 910.

In various exemplary embodiments of the present invention, the cam base 110 is provided to be fixed to the lower mold 3 corresponding to the set portion of the panel material 1 for processing the piercing hole.

The cam base 110 has a base inclined surface 111 inclined downwardly from a rear side to a front side along a set first direction (a forward and backward direction, arrow A in the drawing) on an upper surface.

Furthermore, a base horizontal plane 113 is formed on the upper surface of the cam base 110 along a second direction (left and right direction, arrow B in the drawing) perpendicular to the first direction on the rear side of the base inclined surface 111 have.

Furthermore, the cam base 110 may be provided with accessory elements such as various brackets, plates, housings, covers, and collars for mounting the following components. However, since the above-described accessory elements are for installing the constituent elements on the cam base 110, the aforementioned accessory elements are collectively referred to as the cam base 110 except for exceptional cases in various exemplary embodiments of the present invention.

In various exemplary embodiments of the present invention, the first cam slide 210 is provided on the base inclined surface 111 of the cam base 110 to slide forwards and backwards along a first direction thereof.

The first cam slide 210 is provided in a sliding block type having both side surfaces while forming a vertical surface on the front side thereof. The first cam slide 210 includes at least one driven cam plate 211 corresponding to a cam drive 610 to be described later. The driven cam plate 211 is provided in plural, and is provided on the first cam slide 210 to be inclined downwardly from the front to the rear.

In various exemplary embodiments of the present invention, a guide means for moving the first cam slide 210 forwards and backwards slide along the first direction through the base inclined surface 111 of the cam base 110 is included.

Figure 6:
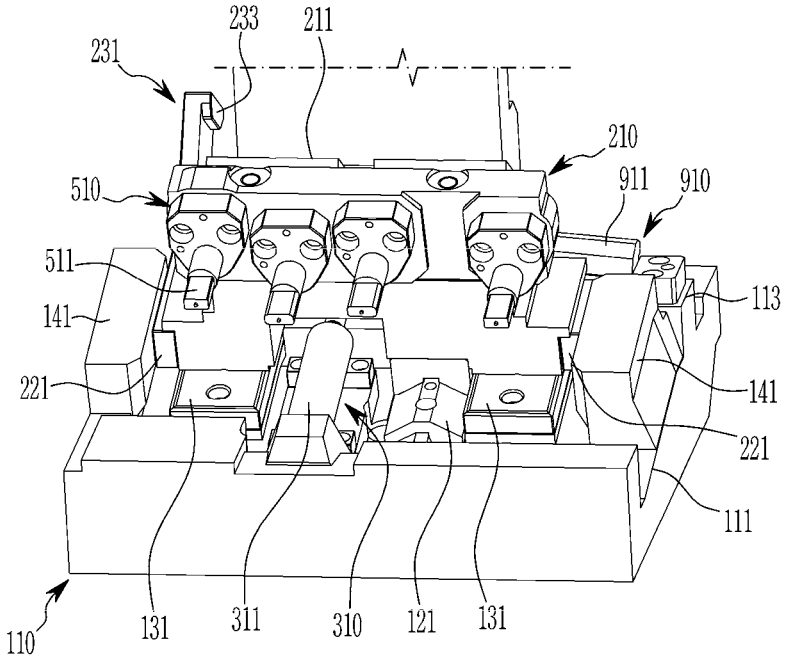
FIG. 6 and FIG. 7A and FIG. 7B are diagrams illustrating a sliding and guide structure of a first cam slide applied to a multi-directional multi-cam type press device according to various exemplary embodiments of the present invention.

As shown in FIG. 6, the guide means includes a main rail block 121 and a sub rail block 131 provided on the cam base 110, and a first guide plate 221 provided on the first cam slide 210.

The main rail block 121 is fixed on the base inclined surface 111. The main rail block 121 is disposed to be inclined downwardly from the rear to the front side in the first direction thereof. The main rail blocks 121 are provided in one or a pair, and are slidably coupled to the lower surface of the first cam slide 210.

The sub rail blocks 131 are provided in a pair, and are fixed on the base inclined surface 111 with the main rail block 121 interposed therebetween. The sub rail block 131 is disposed on the base inclined surface 111 to be inclined downwardly from the rear to the front side in the first direction thereof. The sub rail block 131 is slidably coupled to the lower surface of the first cam slide 210.

Furthermore, the first guide plate 221 is fixed on both sides of the first cam slide 210, respectively. The first guide plate 221 is provided to be in surface-contact with the first guide blocks 141 provided on both sides of the cam base 110.

Figure 7A:
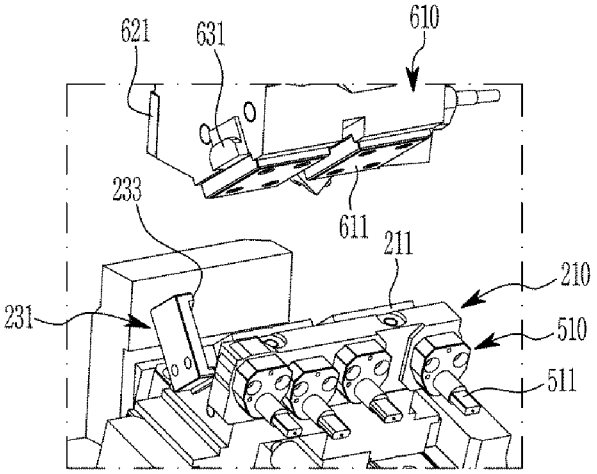
Figure 7B:
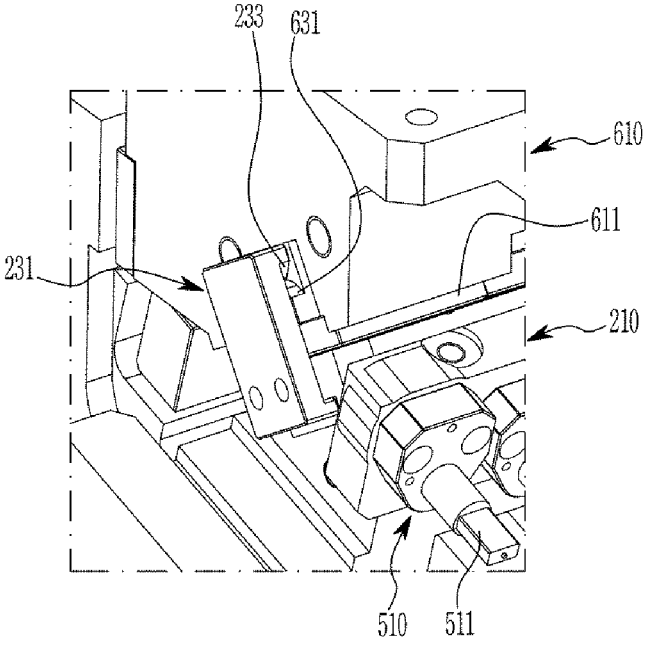

Furthermore, the first cam slide 210 further includes a first return support block 231 fixed on one side thereof, as shown in FIGS. 7A and 7B. The first return support block 231 is configured to support the return movement of the first cam slide 210 with respect to the cam drive 610 to be described later.

The first return support block 231 is fastened to one side of the first cam slide 210. A support protrusion 233 slidably coupled to the cam drive 610 is formed at an upper end portion of the first return support block 231.

Figure 8:
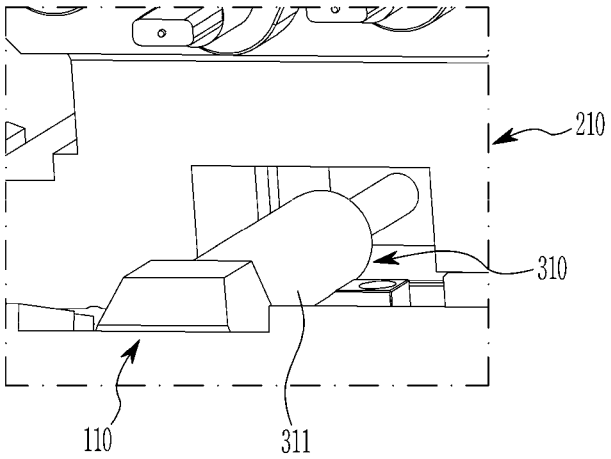
FIG. 8 is a view showing a return spring unit applied to a multi-directional multi-cam type press device according to various exemplary embodiments of the present invention.

In various exemplary embodiments of the present invention, the return spring unit 310 is for returning the first cam slide 210 slid to the front side to its original position. The return spring unit 310 is connected to the front side of the cam base 110 and the front side of the first cam slide 210 in a first direction, as shown in FIG. 8.

The return spring unit 310 may include a gas spring 311. The gas spring 311 is located between the internal side of the cylinder connected to the front side of the cam base 110 and the internal side of another cylinder connected to the front side of the first cam slide 210. Furthermore, it has a gas spring structure of a known technology in which these cylinders are connected in a slip manner.

Figure 9:
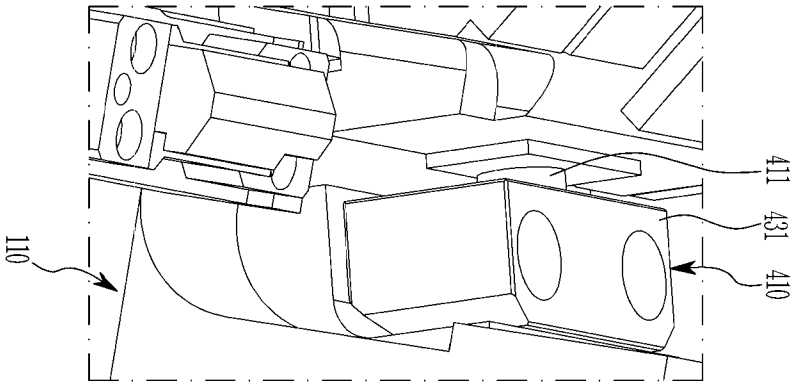
FIG. 9 is a view showing a return stopper applied to a multi-directional multi-cam press device according to various exemplary embodiments of the present invention.

In various exemplary embodiments of the present invention, the return stopper 410 is for limiting the return position of the first cam slide 210, as shown in FIG. 9, and is located on the rear side of the cam base 110 in correspondence with the first cam slide 210. Provided.

The return stopper 410 includes a buffer protrusion 411 for buffering an impact with the first cam slide 210. For example, the buffer protrusion 411 may be fixed to the stopper block 431 in a form of a block made of a rubber material, and may be provided to be flowable to the stopper block 431 through a separate spring.

Referring to FIG. 1 to FIG. 5, in various exemplary embodiments of the present invention, the first punch unit 510 is for processing a piercing hole in a set portion of the panel material 1 by sliding the first cam slide 210 in the first direction thereof.

The first punch unit 510 is fixed on the first cam slide 210 along a first direction thereof. The first punch unit 510 includes a plurality of pierce tools 511 provided on the front surface of the first cam slide 210. The pierce tools 511 are provided on the front surface of the first cam slide 210 to be spaced apart at a predetermined interval along the second direction thereof.

Referring to FIG. 1 to FIG. 5, in various exemplary embodiments of the present invention, the cam drive 610 is for providing a cam driving force to the first cam slide 210 to enable the slide movement of the first cam slide 210.

The cam drive 610 is provided to be fixed to the upper mold 5 of the press mold system corresponding to the first cam slide 210. The cam drive 610 is provided to be in cam contact with the driven cam plate 211 of the first cam slide 210.

The cam drive 610 includes a driving cam plate 611, a second guide plate 621, and a second return support block 631 (see FIGS. 7A and 7B below).

The driving cam plate 611 is provided below the cam drive 610 to allow cam (slip) contact with the driven cam plate 211 of the first cam slide 210.

Figure 10A:
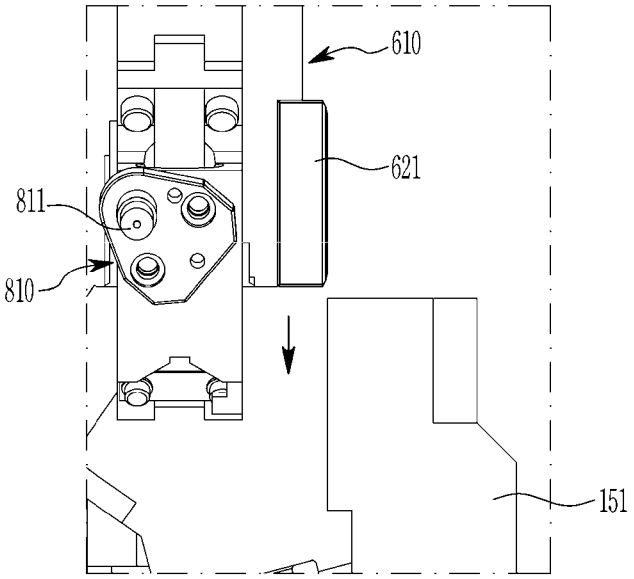
FIG. 10A and FIG. 10B are diagrams illustrating a guide structure of a cam drive applied to a multi-directional multi-cam press device according to various exemplary embodiments of the present invention.
Figure 10B:
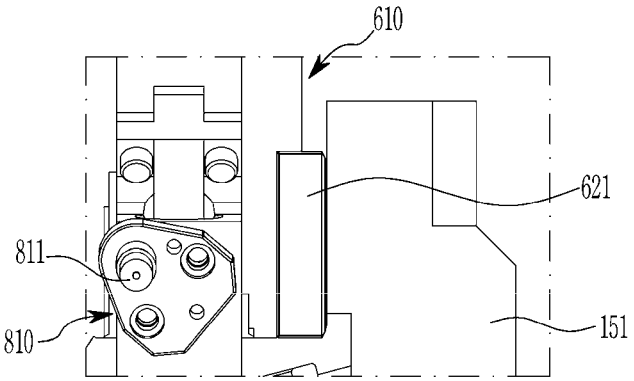

The second guide plate 621 is provided on the rear surface of the cam drive 610 as shown in FIGS. 10A and 10B. The second guide plate 621 is provided to be in surface-contact with the second guide block 151 provided on the rear side of the cam base 110. The second guide plate 621 is configured to guide the cam drive 610 in the vertical direction through the second guide block 151.

Furthermore, the second return support block 631 is provided on a side surface of the cam drive 610 corresponding to the first return support block 231 of the first cam slide 210. The second return support block 631 is slidably coupled to the first return support block 231.

Here, the second return support block 631 supports the return movement of the first cam slide 210 and is slidably coupled with the support protrusion 233 of the first return support block 231. The second return support block 631 assists the return movement of the first cam slide 210 while pulling the first return support block 231 of the first cam slide 210 when the cam drive 610 rises. Giving plays a role.

Referring to FIG. 1 to FIG. 5, in various exemplary embodiments of the present invention, the second cam slide 710 makes cam contact with the cam base 110 side by the movement (drive) of the cam drive 610, and slides forwards and backwards along a second direction perpendicular to the first direction thereof.

The second cam slide 710 has a block shape and is provided to be slidably moved to the rear side of the cam drive 610. To this end, the cam drive 610 includes a guide rail member 641.

Figure 11:
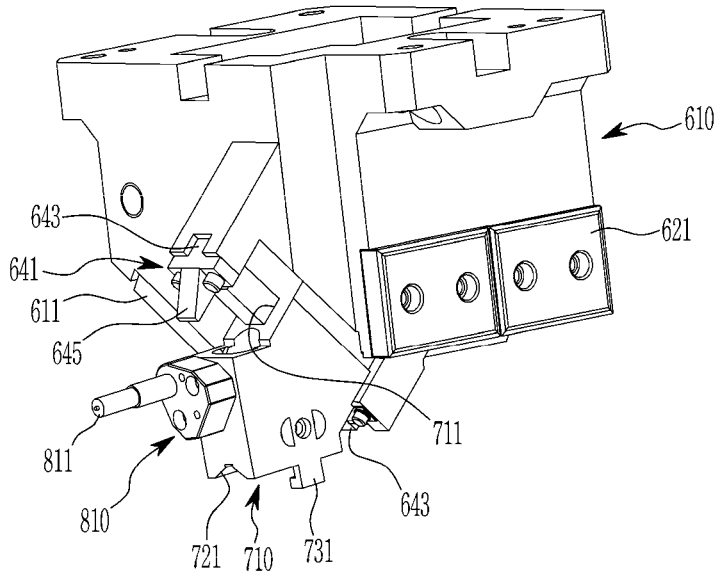
FIG. 11 is a diagram illustrating a guide structure of a second cam slide applied to a cam drive applied to a multi-directional multi-cam press device according to various exemplary embodiments of the present invention.

The guide rail member 641 guides the slide movement of the second cam slide 710. The guide rail member 641 is slidably coupled with the second cam slide 710 at the rear side of the cam drive 610 as shown in FIG. 11 and is provided to be inclined downwardly from one side to the other side along the second direction thereof.

The guide rail member 641 includes a fixed end portion 643 formed at one end portion and the other end portion thereof, and a guide stopper 645 formed at the fixing end portion 643 at the one end portion thereof.

The fixing end portion 643 is fixed to one side and the other side from the rear side of the cam drive 610, respectively. Here, the second cam slide 710 slides between the fixed end portions 643 along the guide rail member 641, and forms a coupling hole 711 which is slidably coupled with the guide rail member 641.

The guide stopper 645 limits the forward position of the second cam slide 710 and is integrally formed with the fixed end portion 643 at one end portion of the guide rail member 641.

Here, when the cam drive 610 is positioned above the first cam slide 210, the second cam slide 710 is in a state of being moved downwards (reverse) along the guide rail member 641 in the other direction of the cam drive 610.

Furthermore, when the cam drive 610 moves downward and comes into cam contact with the first cam slide 210, the second cam slide 710 follows the guide rail member 641 on one side of the cam drive 610 It moves upward (forward) in the direction thereof, and the guide stopper 645 is caught.

Referring to FIG. 1 to FIG. 5, in various exemplary embodiments of the present invention, the second punch unit 810 is for processing a piercing hole in a set portion of the panel material 1 by sliding the second cam slide 710 along the second direction thereof.

The second punch unit 810 is fixed on the second cam slide 710 in a second direction as a single number. The second punch unit 810 includes a pierce tool 811 provided on the side of the second cam slide 710.

Referring to FIG. 1 to referring to FIG. 5, in various exemplary embodiments of the present invention, the cam block 910 selectively makes cam contact with the second cam slide 710 by vertical movement of the cam drive 610, and moves the second cam slide 710 forward and backward slide in the second direction thereof.

The cam block 910 is fixed on the upper surface of the cam base 110, and is disposed on the horizontal base surface 113 of the cam base 110 along the second direction thereof. The cam block 910 has a cam inclined surface 911 inclined downward along the advancing direction of the second cam slide 710, and is slidably coupled to a lower surface of the second cam slide 710. Accordingly, a cam groove 721 is formed on a lower surface of the second cam slide 710 to slide with the cam block 910 and contact with the cam.

Figure 12A:
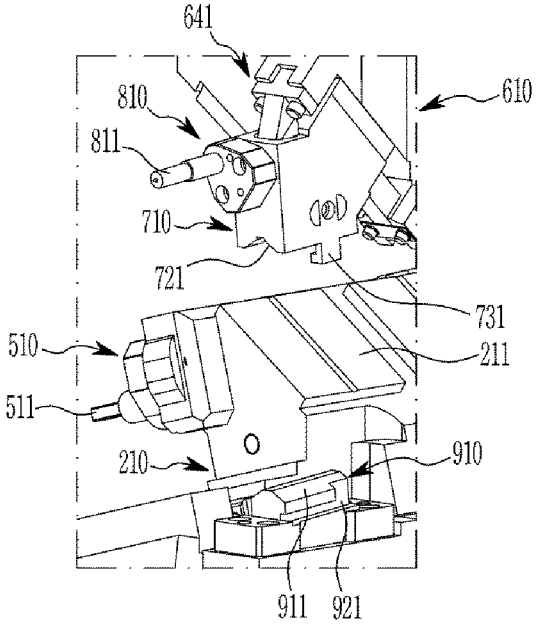
FIG. 12A and FIG. 12B are views showing a guide structure of a cam block and a second cam slide applied to a multi-directional multi-cam type press device according to various exemplary embodiments of the present invention.
Figure 12B:
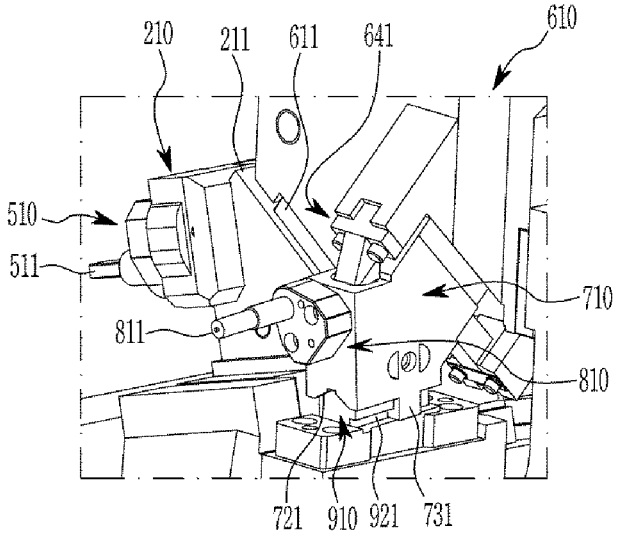

Furthermore, as shown in FIGS. 12A and 12B, the cam block 910 forms a guide groove 921 along the second direction thereof. Furthermore, a guide protrusion 731 slidably coupled with a guide groove 921 is integrally provided at a lower portion of the second cam slide 710.

The guide protrusion 731 is configured to assist the return movement of the second cam slide 710 while pulling the second cam slide 710 through the guide groove 921 when the cam drive 610 rises.

Hereinafter, the operation of the multi-directional multi-cam type press device 100 according to various exemplary embodiments of the present invention configured as described above will be described in detail with reference to the previously included drawings and the accompanying drawings.

Figure 13:
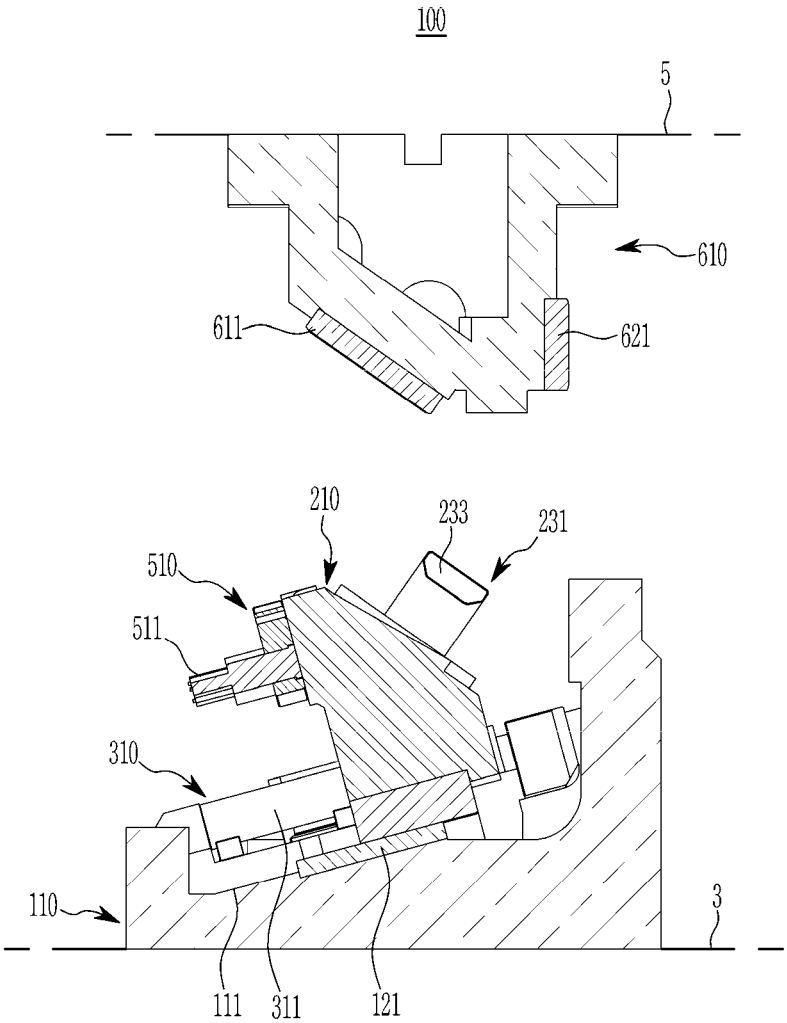
FIG. 13 and FIG. 14 are views for explaining the operation of the multi-directional multi-cam type press device according to various exemplary embodiments of the present invention.
Figure 14:
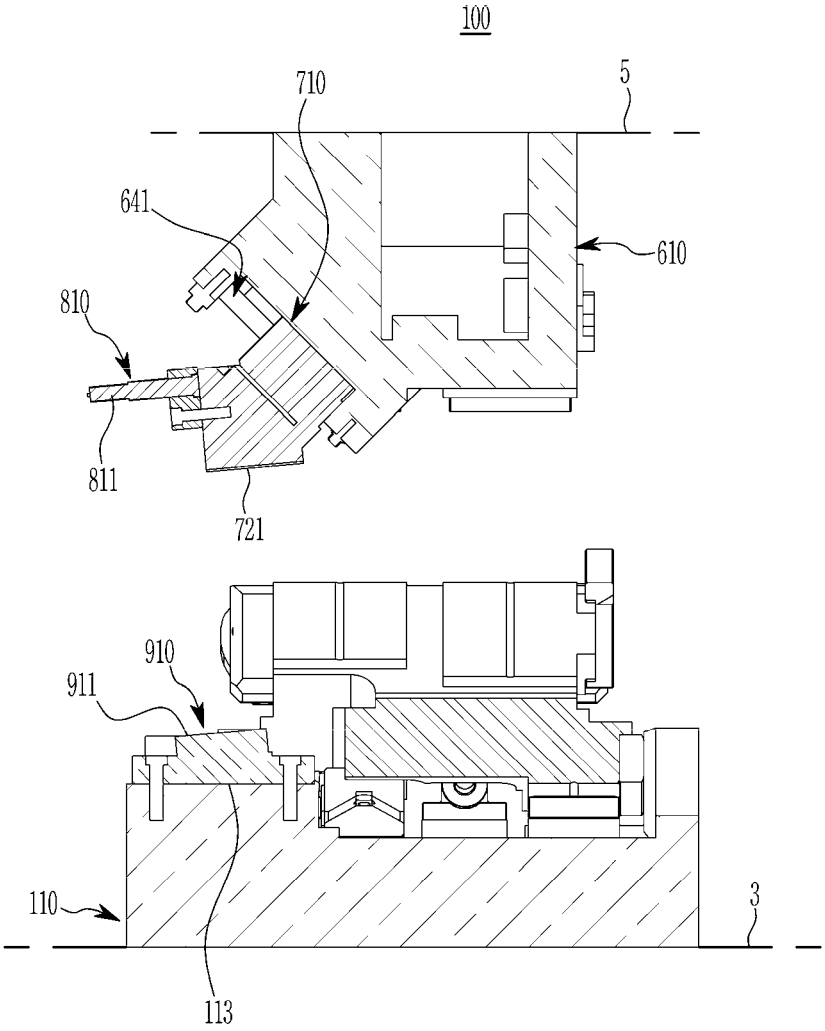

FIG. 13 and FIG. 14 are views for explaining the operation of the multi-directional multi-cam type press device according to various exemplary embodiments of the present invention.

Referring to FIG. 13 and FIG. 14, first, in various exemplary embodiments of the present invention, the upper mold 5 is in a state of being moved upward relative to the lower mold 3. Accordingly, the cam drive 610 is in a state of being moved upward with respect to the first cam slide 210 on the cam base 110.

Here, the first cam slide 210 moves upward and backward together with the first punch unit 510 along the first direction through the main rail block 121, the sub rail block 131 and the first guide plate 221.

In the instant case, the first cam slide 210 is elastically supported by the cam base 110 by the return spring unit 310 and is in close contact with the return stopper 410.

Furthermore, as the cam drive 610 is positioned above the first cam slide 210, the second cam slide 710 is moved backward and downward along the guide rail member 641.

In the state as described above, in the exemplary embodiment of the present invention, the upper mold 5 is moved downwards relative to the lower mold 3, and the panel material 1 is molded into a set shape. In the present process, in the exemplary embodiment of the present invention, as in the drawings included above, the cam drive 610 also moves in a downward direction together with the upper mold 5. Here, the cam drive 610 is guided downward along the second guide block 151 of the cam base 110 through the second guide plate 621.

Accordingly, the cam drive 610 makes cam contact with the driven cam plate 211 of the first cam slide 210 through the driving cam plate 611. Accordingly, the cam drive 610 moves the first cam slide 210 forward and downward along with the first punch unit 510 along the first direction thereof.

Here, the first cam slide 210 slides forward along the first direction while overcoming the elastic force of the return spring unit 310 through the main rail block 121, the sub rail block 131 and the first guide plate 221.

During the present process, as the cam drive 610 descends, the second cam slide 710 comes into cam contact with the cam inclined surface 911 of the cam block 910 through the cam groove 721 on the lower surface. Accordingly, the second cam slide 710 moves upwardly and forward along the guide rail member 641 and is engaged with the guide stopper 645.

In the above process, the second cam slide 710 moves downward along the second direction along with the second punch unit 810 through the cam block 910.

Accordingly, in various exemplary embodiments of the present invention, a piercing hole in the first direction is processed in the panel material 1 through the pierce tool 511 of the first punch unit 510 while going through a series of processes as described above. Furthermore, in various exemplary embodiments of the present invention, a piercing hole in the second direction may be processed in the panel material 1 through the pierce tool 811 of the second punch unit 810.

On the other hand, in the state where the piercing hole is processed in the set portion of the panel material 1 as above, when the upper mold 5 moves upward with respect to the lower mold 3, the cam drive 610 also moves upwards.

Accordingly, in various exemplary embodiments of the present invention, the first cam slide 210 returns to its original position while moving backward by the elastic force of the return spring unit 310. Furthermore, in various exemplary embodiments of the present invention, the second cam slide 710 is returned to its original position while moving backward by an elastic force of a spring not shown in the drawing.

In the multi-directional multi-cam press device 100 according to various exemplary embodiments of the present invention as described so far, the cam base 110 is provided with a first cam slide 210, and the cam drive 610 is provided with a second cam slide 710 moving in a direction different from that of the first cam slide 210.

Accordingly, in various exemplary embodiments of the present invention, the first and second cam slides 710 are moved in different directions by driving a single cam by the cam drive 610, and piercing holes are formed in the panel material 1 in different directions.

Thus, according to the exemplary embodiments of the present invention, since piercing processing in different directions is possible even within the narrow structural space of the press mold without process division, the space constraint condition of the press mold may be overcome, and the mold manufacturing cost and process time may be shortened.

Furthermore, in various exemplary embodiments of the present invention, the cam driving force of the cam drive 610 may be directly transmitted to the first and second cam slides 210 and 710 without passing through a separate medium slide. Therefore, the driving distance of the cam slides 210 and 710 may be sufficiently secured without interference between the cam slides 210 and 710.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A multi-directional multi-cam press device, including:
- a cam base fixed to a lower mold;
- a first cam slide provided to slide forwards and backwards along a first direction of the cam base;
- at least a first punch unit provided in the first cam slide along the first direction;
- a cam drive fixed to an upper mold configured for moving in a vertical direction with respect to the lower mold, and making a contact with the first cam slide;
- a second cam slide provided in the cam drive to move forwards and backwards in a second direction perpendicular to the first direction and in contact with a side of the cam base; and
- at least a second punch unit provided on the second cam slide along the second direction.

2. The multi-directional multi-cam press device of claim 1, further including:
- a return spring unit connected to the cam base and the first cam slide in the first direction.

3. The multi-directional multi-cam press device of claim 2, wherein the return spring unit includes a gas spring.

4. The multi-directional multi-cam press device of claim 2, further including:
- a return stopper provided on the cam base corresponding to the first cam slide and configured to limit a return position of the first cam slide.

5. The multi-directional multi-cam press device of claim 1, wherein the cam base includes at least one main rail block which is mounted to be inclined downwardly from a rear side to a front side through a base inclined surface as an upper surface, and is slidably coupled with the first cam slide.

6. The multi-directional multi-cam press device of claim 5, wherein the cam base includes a pair of sub-rail blocks provided on the base inclined surface with the main rail block interposed therebetween, and slidably coupled with the first cam slide.

7. The multi-directional multi-cam press device of claim 1, wherein the first cam slide includes at least a driven cam plate mounted to be inclined downwardly from a front to a rear corresponding to the cam drive.

8. The multi-directional multi-cam press device of claim 7, wherein the first cam slide includes a first guide plate fixed on one side surface and another side surface of the first cam slide and provided to be in contact with a first guide block provided on a first side and a second side of the cam base.

9. The multi-directional multi-cam press device of claim 7, wherein the cam drive includes a driving cam plate provided to be in contact with the at least a driven cam plate.

10. The multi-directional multi-cam press device of claim 1, wherein the first cam slide includes a first return support block fixed on at least one side thereof and slidably coupled to the cam drive.

11. The multi-directional multi-cam press device of claim 10, wherein the cam drive includes a second return support block provided on a side surface corresponding to the first return support block and slidably coupled with the first return support block.

12. The multi-directional multi-cam press device of claim 1, wherein the cam drive includes a second guide plate provided on a rear surface thereof and provided in contact with a second guide block provided on a rear side of the cam base.

13. The multi-directional multi-cam press device of claim 1, wherein the cam drive includes a guide rail member which is provided to be inclined downwardly from one side to another side along the second direction from a rear side thereof and slidably couples with the second cam slide.

14. The multi-directional multi-cam press device of claim 13, wherein the guide rail member includes:
- first and second fixed end portions formed at one end portion and at another end portion of the guide rail member and fixed to a first side and a second side of the cam drive, respectively, and
- a guide stopper formed at the fixed end portion of the one end portion and limiting a forward position of the second cam slide.

15. The multi-directional multi-cam press device of claim 14, wherein the second cam slide has an engaging hole slidably coupled with the guide rail member, and slides between the first and second fixed end portions along the guide rail member.

16. The multi-directional multi-cam press device of claim 1, further including:
- a cam block provided on a base horizontal surface of an upper surface of the cam base, having a cam inclined surface inclined downwardly along the second direction of the second cam slide, and slidably coupled to a lower surface of the second cam slide.

17. The multi-directional multi-cam press device of claim 16, wherein on the lower surface of the second cam slide, a cam groove for contacting with the cam block is formed.

18. The multi-directional multi-cam press device of claim 16,
- wherein a guide groove is formed in the cam block along the second direction, and wherein a guide protrusion slidably coupled to the guide groove is provided at a lower portion of the second cam slide.

19. The multi-directional multi-cam press device of claim 1, wherein the at least a first punch unit and the at least a second punch unit include a pierce tool for piercing a panel material.

* * * * *